United States Patent [19]

Yessler, II

[11] 4,398,463

[45] Aug. 16, 1983

[54] NON-REPEAT DOCTOR BLADE DRIVE

[75] Inventor: Ralph A. Yessler, II, York, Pa.

[73] Assignee: Motter Printing Press Co., York, Pa.

[21] Appl. No.: 294,317

[22] Filed: Aug. 19, 1981

[51] Int. Cl.[3] ..... B41F 9/10

[52] U.S. Cl. ..... 101/169; 101/157; 91/306

[58] Field of Search ..... 101/169, 157, DIG. 14, 101/348, 349; 91/39, 40, 305, 306; 118/120

[56] References Cited

U.S. PATENT DOCUMENTS

| | | | |
|---|---|---|---|
| 2,447,090 | 8/1948 | Pollock | 101/169 |
| 2,955,460 | 10/1960 | Stevens et al. | 91/40 |
| 3,009,446 | 11/1961 | Sunnen | 91/39 |
| 3,087,184 | 4/1963 | Ljungquist | 15/256.51 |
| 3,620,126 | 11/1971 | Fuhrimann | 91/306 |
| 3,771,421 | 11/1973 | Schaffer | 91/306 |
| 3,782,246 | 1/1974 | Hilbrands | 91/306 |
| 3,983,812 | 10/1976 | Schramm | 101/DIG. 14 |

FOREIGN PATENT DOCUMENTS

| | | | |
|---|---|---|---|
| 2459392 | 6/1975 | Fed. Rep. of Germany | 101/169 |
| 2731124 | 1/1979 | Fed. Rep. of Germany | 101/DIG. 14 |
| 9135 | of 1888 | United Kingdom | 101/169 |

OTHER PUBLICATIONS

Pamphlet Entitled, GRI "The Latest Generation of Rotogravure Presses for Publication Printing" by Dr.-Ing. Carlo Cerutti, 1976.

Pamphlet Entitled, GRI "The Future of Gravure According to a Press Manufacturer" by Dr.-Ing. Carlo Cerutti, 1977.

Cerruti Paper by Paul Cappa Entitled, "Cerruti for the U.S. Market", p. 90, 1980.

Page 6 from a 1969 Motter Press Specification.

Pages from an Albert-Frankenthal Brochure Entitled, "Gravure Printing Unit TR5 S".

Albert-Frankenthal Advertisement entitled "Albert has all the Features . . . ".

Paper Presented at 1979 European Rotogravure Assn. Meeting "TR5 S and TR6 S . . . " by Gebhard.

*Primary Examiner*—William Pieprz

*Attorney, Agent, or Firm*—Brumbaugh, Graves, Donohue & Raymond

[57] ABSTRACT

A drive for the doctor blade of a gravure type printing press oscillates the doctor blade in a non-repeating motion. A doctor slide is coupled to the doctor blade, and oscillated on the frame by a first piston-cylinder unit. A pneumatic valve slide is driven back and forth on the frame by a second piston cylinder unit, between a first pair of end stops mounted on the doctor slide and between a second pair of end stops mounted on the frame. Upon engagement of the end stops on the doctor slide, the valve slide provides a pressure signal to reverse the direction of motion of the doctor slide. Upon engagement of the end stops on the frame, the valve slide provides a pressure signal to reverse its own direction of motion on the frame.

26 Claims, 3 Drawing Figures

NON-REPEAT DOCTOR BLADE DRIVE

BACKGROUND OF THE INVENTION

The present invention is an improvement in a method and apparatus for oscillating the doctor blade used in a gravure type printing press.

In intaglio printing, the gravure cylinder, having a highly polished copper or steel surface etched or engraved with the design to be printed, rotates through a trough of ink, which is held on the surface as well as in the etched wells. As the cylinder continues its rotation, it passes under a doctor blade, which is a thin, flexible steel blade or scraper that extends the entire length of the cylinder and bears at an angle against it. The doctor blade wipes by scraping the printing cylinder surface clean to leave ink only in the etched walls. The ink left in the wells is then transferred to a paper web travelling between the gravure cylinder and a rubber impression roller pressing the web against the gravure cylinder. Optionally, a back up or pressure roller may be mounted in a tangential relationship with the impression roller for assuring that the proper pressure is exerted by the impression roller on the gravure cylinder to pull the ink out of the etched wells and onto the paper.

To minimize wear and the possible effects of small nicks, the doctor blade is made to oscillate lengthwise against the cylinder. Preferably, however, the blade is oscillated in non-repeating cycles, i.e. such that the blade does not repeat its exact motion each stroke. In comparison to drives in which the doctor blade moves in a repeating oscillation motion, a doctor blade drive producing non-repeat back and forth motion reduces doctor blade wear and the incidence of cracked doctor blades. The non-repeat feature also acts to dislodge foreign particles, such as paper lint, from under the doctor blade. If such particles lodge under the doctor blade, the printing cylinder may be damaged, the printing quality can be adversely affected, and press down time is increased. All these factors result in lost production.

In the past, simple oscillation systems have used mechanical devices such as eccentrics driven from the press drive or a hydraulic cylinder to produce a repeating push-pull motion. Doctor blades have also been oscillated by a mechanical drive operated off the press to produce a non-repeat oscillation. In another system producing a non-repeat oscillation, the doctor blade is driven back and forth by a combination of hydraulic, pneumatic and mechanical systems.

Non-repeat mechanical drives operated from the press are disadvantageous in that they may induce drive disturbances in the doctor blade motion affecting printing quality. Also, such mechanical drives connected to the press drive have a fixed speed ratio, related to the press drive rpm, and the rate of oscillation cannot be changed. The known non-repeat drive using the combined hydraulic, pneumatic and mechanical systems is complicated and expensive. It also requires considerable maintenance resulting in operators bypassing the non-repeat feature and using the system as a simple push-pull motion. The simple oscillating system driven from the press and using an eccentric control has the same shortcomings as the mechanical non-repeat systems described above.

SUMMARY OF THE INVENTION

The present invention is a method and apparatus for oscillating the doctor blade used in a gravure type printing press to wipe the ink from the printing cylinder, which does not repeat its exact motion each stroke and which is not operated off a press drive. The rate of oscillation is not press-speed dependent and may be selected and changed as desired.

More particularly, in a drive in accordance with the invention the doctor blade is mounted on a doctor slide which is moveable relative to the printing press frame back and forth in the longitudinal direction of the doctor blade. The back and forth oscillating motion of the doctor slide and thereby the doctor blade is controlled by a first drive unit, in the form of a hydraulic piston and cylinder unit, connected between the doctor slide and the printing press frame. The drive is controlled by a pneumatic valve slide which moves back and forth on the frame in the longitudinal direction between a pair of stops mounted on the doctor slide. Upon engagement of one of the stops, the pneumatic slide, which is supplied with pressurized air, provides a pressure signal to a hydraulic control valve to cause the piston and cylinder unit to reverse the direction of movement of the piston and thereby of the doctor slide.

The pneumatic valve slide, which as described above is slideably mounted on the frame, is driven back and forth on the frame in the longitudinal direction by a second drive unit. The second drive unit is in the form of a second piston and cylinder unit, mounted between the valve slide and the frame. The second drive is controlled dependent upon the position of the pneumatic valve slide relative to the printing press frame. The pneumatic valve slide moves back and forth between end stops fixed relative to the frame. When the pneumatic valve slide engages one of the stops, it delivers a pressure signal to a second hydraulic control valve (associated with the second piston/cylinder unit) to reverse the direction of movement of the piston of the second drive. This reverses the direction of motion of the pneumatic valve slide.

Thus, in accordance with this arrangement the control for the first drive, i.e. the pneumatic valve slide, which is actuated upon the engagement of its corresponding end stops, is moved relative to the end stops by the second drive, itself controlled as a function of the position of the pneumatic valve slide relative to the frame. A compound motion control of the doctor slide relative to the frame is produced, and the resultant back and forth movement of the doctor blade is non-repeating.

Preferably, the first and second drives are fed from a common source of pressurized hydraulic fluid. Each of the hydraulic piston and cylinder units has a pair of ports, and the hydraulic control valves supply the pressurized fluid selectively to one of the ports and discharge fluid from the other port, depending upon the pressure signal from the pneumatic valve slide. Fluid discharged from the cylinders is throttled to control the rate of movement of the pistons.

While in the foregoing described apparatus the first drive is controlled by the position of the pneumatic valve slide relative to the doctor slide and the second drive is controlled responsive to the position of pneumatic valve slide relative to the frame (fixed stops), the pneumatic controls may be reversed and still produce a compound, non-repeating control signal for moving the doctor slide back and forth.

For a better understanding of the invention, reference is made to the following detailed description of a preferred embodiment, taken in conjunction with the drawings accompanying the application.

DETAILED DESCRIPTION OF A PREFERRED EMBODIMENT

Figure 1:
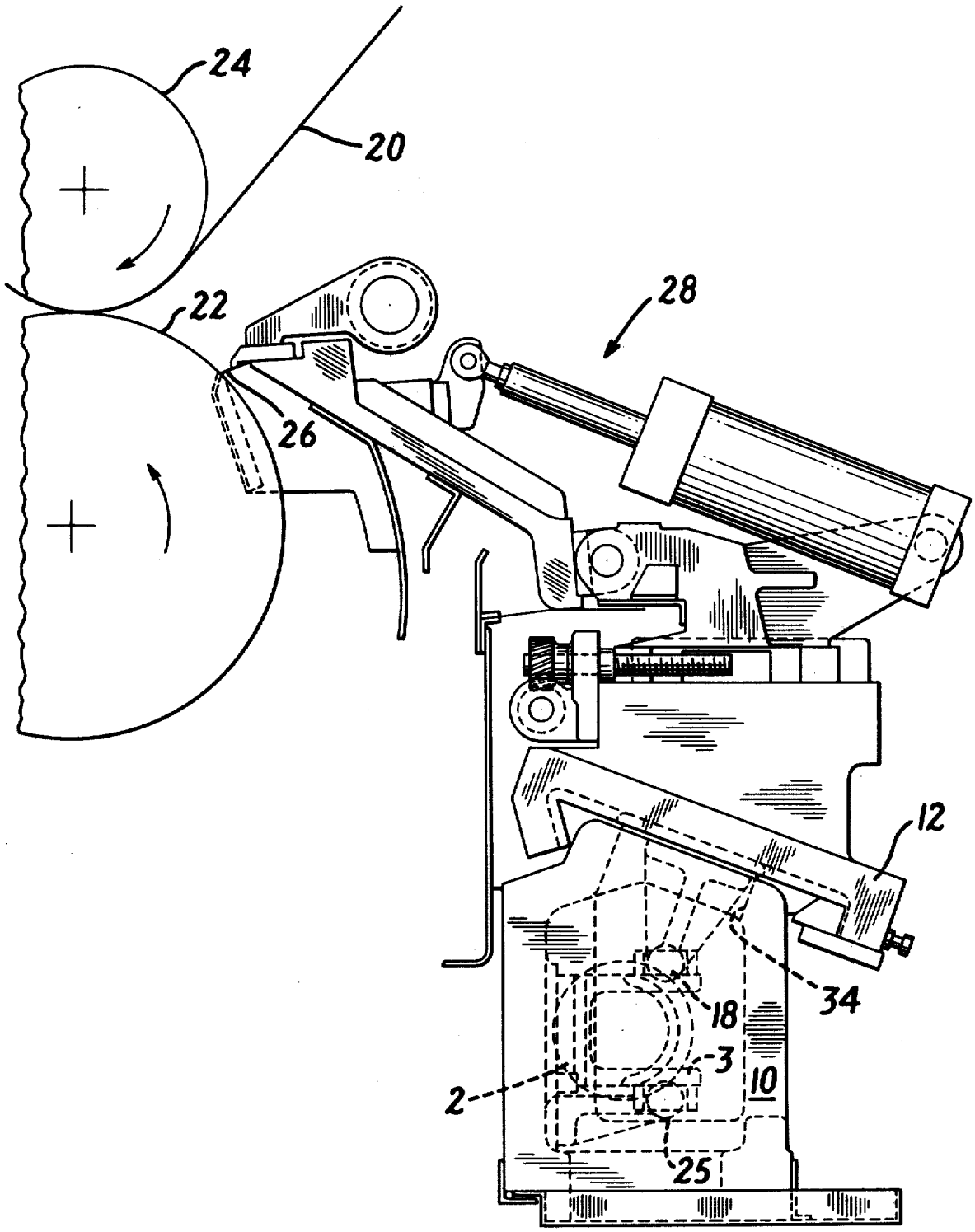
FIG. 1 is a side view of a portion of a printing press incorporating a doctor blade drive in accordance with the invention.

Referring to FIG. 1, a web of paper stock 20 is passed between a gravure or printing cylinder 22 and a rubber impression roller 24 pressing the web against the gravure cylinder 22. A backup or pressure roller (not shown) is sometimes mounted above the impression roller 24 for ensuring the proper pressure between the impression roller 24 and the gravure cylinder 22.

The printing cylinder 22 rotates through a trough of ink (not shown) disposed below the cylinder 22. Prior to encountering the web 20, the printing cylinder 22 passes under a doctor blade 26 which wipes the surface of the printing cylinder 22 clean, leaving ink only in the etched wells.

In the particular doctor blade assembly as shown, the doctor blade 26 is held against the printing cylinder 22 by a pivoting linkage 28, which includes a piston-cylinder unit for selectively moving the blade 26 away from the cylinder, for example while changing printing cylinders.

The linkage 28 is in turn supported on a carriage or doctor slide 12, which forms part of a drive for oscillating the doctor blade 26 back and forth in a non-repeating motion.

The doctor blade assembly and linkage shown in FIG. 1 is an example of an assembly commercially available. The particular assembly chosen for use with the doctor blade drive of the present invention forms no part of the invention per se.

The doctor carriage 12 is disposed above the frame 10 and mounted on the frame 10 to be longitudinally slideable thereon. As described further below, the doctor slide 12 is oscillated back and forth relative to the frame 10 by a hydraulic piston-cylinder unit 11 mounted between the frame 10 and the doctor slide 12.

Figure 2:
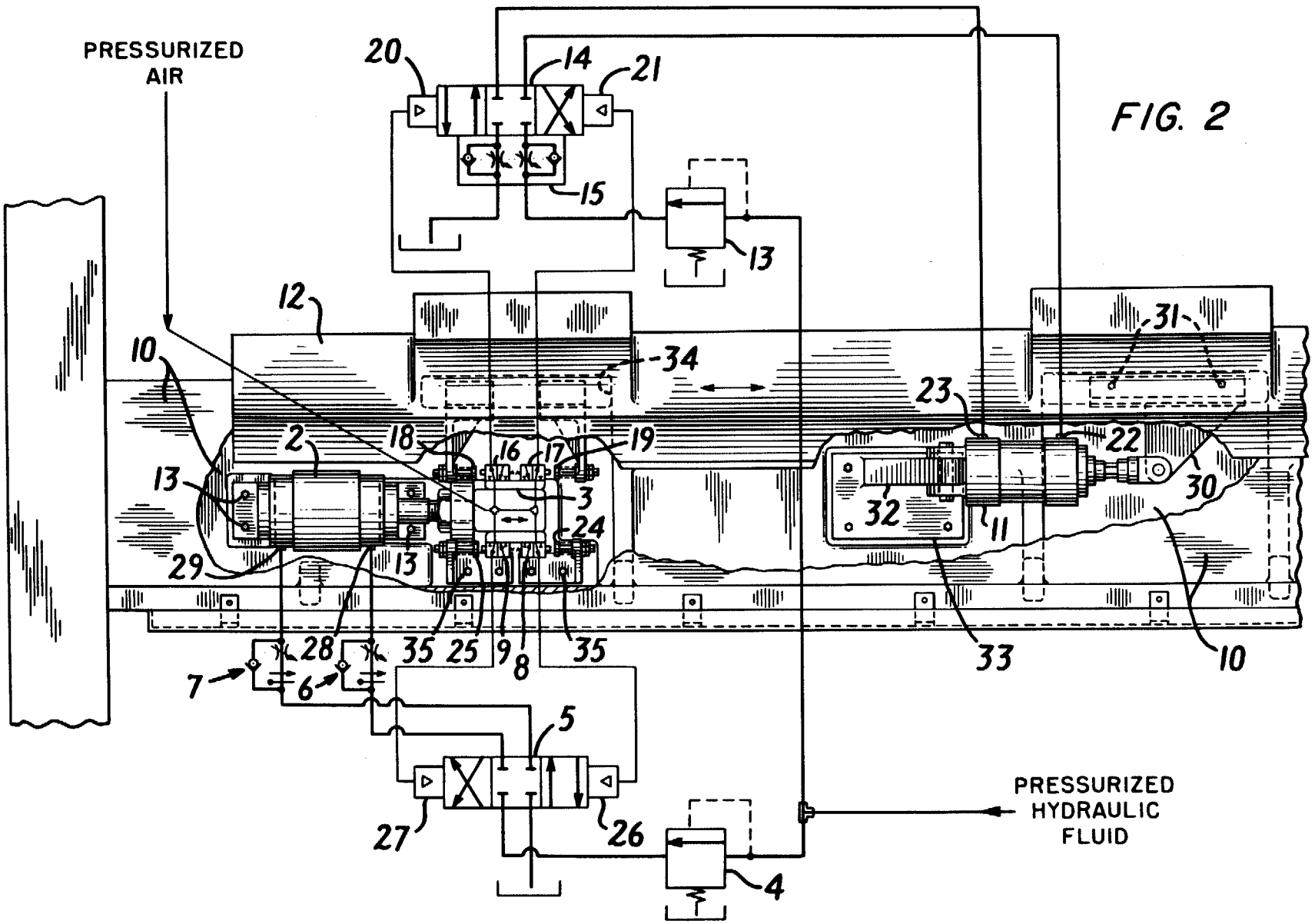
FIG. 2 is a front view, partially in schematic form, of the doctor blade drive mechanism illustrated in FIG. 1.

Referring to FIG. 2, the drive components for the doctor slide 12 are illustrated, with the pneumatic and hydraulic controls represented schematically. A first drive unit, piston-cylinder unit 11, is mounted at one end to a bracket 30 which is attached to the doctor slide 12, for example by bolts indicated at 31. At its other end, the piston-cylinder unit 11 is attached by bracket 32 to a plate 33 bolted to a portion of the frame 10. Extension and retraction of the piston of the piston-cylinder unit 11 causes back and forth movement of the doctor slide 12 and of the doctor blade 26 relative to the frame 10, and therefore relative to the printing cylinder 22.

The doctor blade drive also includes a pneumatic valve slide 3, which provides pressure signals to a double air pilot directional control valve 14 for selectively supplying hydraulic fluid to the piston-cylinder 11. The pneumatic valve slide 3 includes a first pair of valves 16 and 17, which are supplied with pressurized air. A pair of valve trip brackets 18 and 19, which extend through a cut-out 34 in the frame 10, are fixedly mounted on the doctor slide 12 to move back and forth with the doctor slide 12. As the doctor slide 12 moves back and forth, the pneumatic valve brackets 18 and 19 alternately engage the pneumatic valves 16 and 17 to send alternating pressure signals to the hydraulic control valve 14. Each pressure signal causes the valve 14 to reverse the direction of movement of the doctor slide 12 and thereby of the doctor blade 26.

Figure 3:
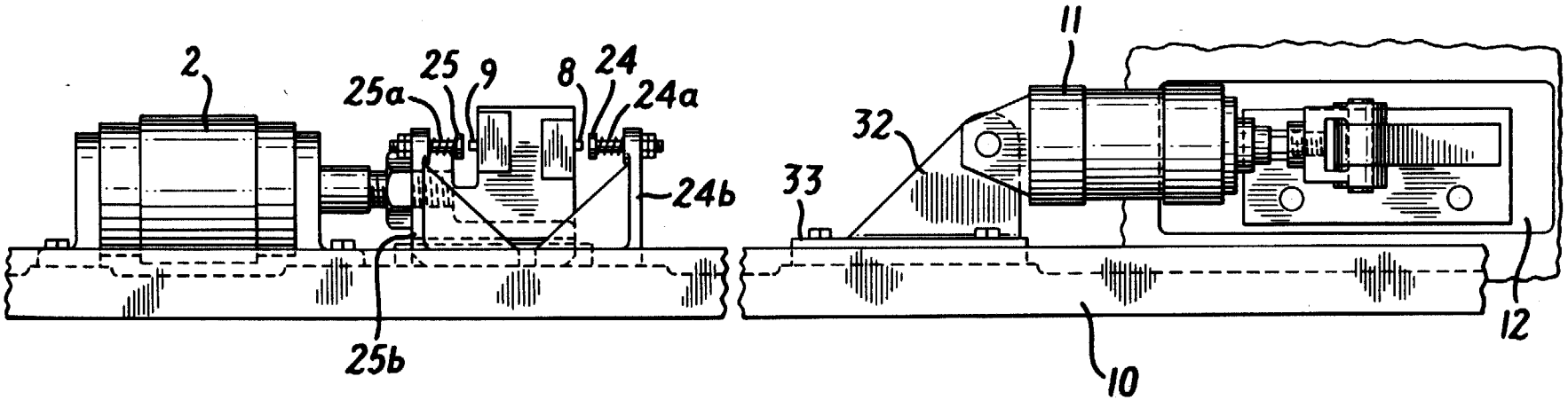
FIG. 3 is a bottom view of a portion of the doctor blade drive mechanism shown in FIG. 2.

The pneumatic valve slide 3 incorporates a second pair of pneumatic valves 8 and 9. The valves 8 and 9 are also supplied from the source of pressurized air and provide pneumatic control signals to a second double air pilot directional control valve 5. The control valve 5 delivers hydraulic fluid to a second drive unit, in the form of a second hydraulic piston-cylinder unit 2. The second piston-cylinder unit 2 is coupled between the pneumatic valve slide 3 and the frame 10, the latter by bolts 13, such that extension and retraction of the piston of the unit 2 causes a back and forth longitudinal movement of the pneumatic valve slide 3 on the frame 10. A second pair of valve trip brackets 24 and 25 are fixedly mounted to the frame 10 by bolts 35 and arranged to act as end stops for the pneumatic valves 8 and 9 during back and forth movement of the pneumatic valve slide 3. Preferably, as shown in FIG. 3, the valve trip brackets 24, 25 (and similarly brackets 18 and 19) include stops **24*a*, 25*a* for engaging the valves 8, 9 (and 16, 17) that are longitudinally spring mounted in supporting brackets 24*b*, 25*b***. Rather than using the spring mounted shown, a flat spring type bracket can be employed.

The doctor slide 12 is shown in its central position. In operation, the brackets 18 and 19 would not remain lined up with the counterpart brackets 24 and 25, since the brackets 18 and 19 move with the doctor slide 12 relative to the frame 10 and thereby relative to the fixed brackets 24 and 25.

Pressurized hydraulic fluid is delivered to the hydraulic piston-cylinder unit 2 and 11 from a common presssurized fluid source. The working pressure of the fluid delivered to the piston-cylinder unit 2 is controlled by a relief valve 4. The double air pilot directional control valve 5 (actuated, in turn, by the pneumatic valve 8 or 9) directs pressurized fluid to one of the ports 28 or 29 of cylinder 2. The other port of hydraulic cylinder 2 is vented through valve 5 through one of the two pressure compensated flow control valves 6 and 7, which throttles the flow of fluid exiting from the non-pressurized side of the piston. As shown, the valves 6 and 7 have a bypass check valve portion, such that while fluid discharged from ports 28 and 29 is throttled, fluid delivered to the port 28 or 29 is not.

The pressure of the fluid delivered to the piston-cylinder unit 11 is controlled by a pressure relief valve 13. One of the two ports, 22 or 23, of the piston-cylinder unit 11 is supplied with the pressured fluid as determined by the position of the double air pilot directional control valve 14. The valve 14 is actuated by the two pneumatic valves 16 and 17, which are mounted on and slide back and forth with the pneumatic valve slide 3 between the actuating stops 18, 19. The unpressurized port of the hydraulic cylinder 11 is vented through valve 14 and through a sandwich flow control valve 15, which is similar to the pressure compensated flow control valves 6 and 7 and throttles the discharge flow. The use of the flow control valves 6, 7 and 15 makes the oscillation action smooth with a minimum pause or jerk at the reversing point.

The operation of the drive control will now be described. Starting arbitrarily from one point during the cycle, the piston-cylinder unit 11 moves the doctor slide 12 toward the left in FIGS. 2 and 3. The valve trip bracket 19 engages the pneumatic valve 17 of the slide 3, and the actuated valve 17 transmits a pressure signal to pilot 21 on the double air pilot directional control valve 14. Pressurized hydraulic fluid is thereby delivered to the input port 23 of the piston-cylinder unit 11, which causes the direction of movement of the doctor slide 12 to be reversed such that it now moves toward the right in FIG. 2. Hydraulic fluid from port 22 is discharged through the sandwich flow control valve 15 at a throttled rate to control the rate of movement of the doctor slide 12.

As the doctor slide 12 continues its movement toward the right, the valve bracket 18 engages the pneumatic valve 16. Pressurized air is delivered through the valve 16 to the pilot 20 on the double air pilot directional control valve 14, reversing the flow of fluid to hydraulic cylinder 11 from port 23 to port 22. The direction of movement of the doctor slide 12 and doctor blade 26 are thereby reversed. This cycle is repeated as long as air and hydraulic fluid are supplied to the system.

If the valve slide 3 were to remain stationary, the engagement of the brackets 18 and 19 and valves 16 and 17 would be periodic, and the back and forth oscillation of the doctor slide 12 would be repeating. However, during the cycle described above, the valve slide 3 is also caused to oscillate, producing a non-repeating motion of the doctor slide 12. Where the valve slide 3 initially moves to the right, the double air pilot directional control valve 5 is in a position displaced toward the right in FIG. 2, such that pressurized fluid is delivered through the valve 5 to port 29. Fluid from port 28 is vented and discharged through the valve 6 at a throttled rate to control the rate of movement of valve 3.

As the valve slide 3 moves toward the right, pneumatic valve 8 contacts the valve trip bracket 24, which actuates pilot 26 on the double air pilot directional control valve 5. Actuation of the pilot 26 reverses the flow of fluid to hydraulic cylinder 2 from hydraulic input port 29 to the hydraulic input port 28. The piston of the piston-cylinder unit 2 is then caused to retract, reversing the direction of motion of the pneumatic valve slide 3, which then moves toward the left. Thereafter, the pneumatic valve 9 engages the valve trip bracket 25, which actuates pilot 27 on the double air pilot directional control valve 5, again reversing the flow of the fluid to the hydraulic cylinder 2 and the direction of motion of the pneumatic valve slide 3. This cycle is repeated as long as air and hydraulic fluid are supplied to the system.

Movement of the pneumatic valve slide 3 relative to the stops 18 and 19 is caused both by the drive 2 and by the drive 11. Movement of the doctor slide 12 towards the right results in a corresponding component of motion of the pneumatic valve slide 3 to the left (relative to the brackets 18 and 19) toward the valve bracket 18. At the same time, the drive 2 may be moving the pneumatic valve slide 3 towards the left, which accelerates the engagement of valve 16 and bracket 18. Alternatively, during movement to the right of the doctor slide 12, the drive 2 may also be moving the valve slide to the right relative to the doctor slide 12, which retards the engagement of valve 16 and bracket 18.

As thus can be perceived from the foregoing description, the movement of the doctor slide 12 back and forth is controlled by two, non-synchronous control systems. The double air pilot directional control valve 14, regulating the back and forth movement of the doctor slide 12, is controlled by the back and forth movement of the pneumatic valves 16 and 17 between stops 18, 19. The relative back and forth movement between the valves 16 and 17 and the stops 18 and 19, however, is not a repeating cycle, but is a function of the composite motion imparted by the two controlled piston cylinder units 2 and 11.

The rate of movement of the doctor slide 12 and rate of movement of the pneumatic valve slide 3 are dependent upon the pressure of the hydraulic fluid which is delivered to the respective hydraulic cylinders 11 or 2, and also by the degree of throttling from the discharge side of the cylinder 11 or 2 produced by the sandwich flow control valve 15 or the pressure compensated flow control valves 6 and 7. Thus, the rate of back and forth movement of the blade 26 may be changed by raising or lowering the hydraulic pressure to the system or the fluid throttling characteristics. Also, the resultant oscillation stroke produced may be varied by changing the relative hydraulic pressures delivered to the respective cylinders 11 and 2, or by changing the discharge throttling characteristics of one piston-cylinder unit relative to the other. This will change the relative speeds of motion of the pneumatic valve slide 3 and doctor slide 12.

Where the spacing between the stops 18, 19 and the valves 16, 17 and between the stops 24, 25 and the valves 8, 9 are equal, in order to establish non-repeat cycling the fluid pressure to or throttling characteristics of each cylinder is selected such that, for the relative bore size and output loads of the two cylinder units 2 and 11, the rates of movement of pneumatic valve slide 3 relative to the frame 10 and of the doctor slide 12 relative to the frame are not identical. The system requires no maintenance and once the desired oscillation is set no further adjustments are required.

In the doctor drive control system shown, the pneumatic control signal actuating the double air pilot directional control valve 14 is provided as a function of the relative position of the pneumatic valve slide 3 relative to the doctor slide 12 (since brackets 18 and 19 are mounted on the double slide 12). Also, the pneumatic control signal provided to actuate the hydraulic cylinder 2 is provided as a function of the position of the pneumatic valve slide 3 relative to the frame (brackets 24 and 25 being mounted on the frame). If desired, the control apparatus could be reversed, for example by having pneumatic valves 16 and 17 control hydraulic valve 5 and having valves 8 and 9 control hydraulic valve 14, to produce a non-repeat motion of the doctor blade 26. In such a case, the cylinder 2 would be controlled as a function of the position of the valve slide 3 relative to the doctor slide 12, and the cylinder 11 would be controlled as a function of the position of the valve slide 3 relative to the frame 10.

The foregoing represents a description of a preferred embodiment of the invention. Variations and modifications will be apparent to persons skilled in the art without departing from the inventive concepts disclosed herein. For example, the spacing between the bracket pairs 18, 19 and 24, 25 may be changed to modify the resultant non-repeat oscillation. The moveable stops do not have to be mounted on the doctor slide, only on a member that oscillates. Rather than fixing the stops 24, 25 on the frame such that the valve slide 3 moves at a set cycle, the stops 24, 25 could be mounted on another drive cylinder to introduce another variable into the resultant motion. Also, while in the embodiment shown fluid is throttled on the discharge side of the piston-cylinder units 2 and 11 to control the movement of the doctor slide 12 and valve slide 3, if desired fluid can be throttled going into the cylinder ports. All such modifications and variations are intended to be within the scope of the invention as defined in the following claims.

I claim:

1. In a printing press having a frame, a printing cylinder, a press drive, and a doctor blade engaging a surface of said cylinder and longitudinally displaceable along said cylinder, a drive for oscillating said doctor blade along said cylinder in a non-repeat motion comprising:

(a) a doctor slide coupled to said doctor blade and mounted on said frame to be moveable in said longitudinal direction;

(b) first drive means arranged between said doctor slide and said frame for moving said doctor slide back and forth in said longitudinal direction;

(c) reference indicia means comprising first reference indicia, second reference indicia, and means for moving one of said reference indicia back and forth relative to the other;

(d) a control member;

(e) second drive means for moving said control member back and forth relative to said reference indicia;

(f) means for actuating said first drive means including a first control means independent of said press drive and responsive to the position of said control member relative to one of said first reference indicia and said second reference indicia for controlling the actuation of said first drive means for reversing the direction of movement of said doctor slide; and (g) second control means responsive to the position of said control member relative to the other of said first reference indicia and said second reference indicia for actuating said second drive means for reversing the direction of movement of said control member.

2. A printing press as defined in claim 1, wherein said first reference indicia is mounted to said doctor slide for movement therewith in said longitudinal direction and wherein said means for moving said first reference indicia relative to said second reference indicia comprises said first drive means.

3. A printing press as defined in claim 2, comprising means for moving said second reference indicia back and forth in said longitudinal direction.

4. A printing press as defined in claim 2, wherein said first and second drive means comprises a first and second piston and cylinder unit, respectively, and wherein said second piston and cylinder unit is arranged between said frame and said control member for moving said control member in said longitudinal direction.

5. A printing press as defined in claim 4, wherein said first reference indicia includes a first pair of longitudinally spaced ends stops mounted to said doctor slide, and wherein said second reference indicia includes a second pair of longitudinally spaced end stops mounted to said frame.

6. A printing press as defined in claim 5, wherein each of said first and second drive means comprises a source of pressurized fluid, first and second valve means for supplying said fluid to said first and second piston and cylinder unit, respectively, and wherein said first and second control means comprise pneumatic control means for generating a pressure signal for actuating the respective valve means for oscillating said doctor slide and said member, respectively.

7. A printing press as defined in claim 6, wherein said control member comprises a valve slide, and said pneumatic control means comprises first and second pairs of pneumatic valve means on said valve slide arranged to engage said first and second pairs of end stops, respectively, for generating a pressure signal upon each engagement of an end stop.

8. A printing press as defined in claim 7, wherein said stops are spring mounted on supports for resiliently engaging said pneumatic valve means.

9. A printing press as defined in claim 7, wherein each of said first and second piston and cylinder units comprises a pair of hydraulic ports, wherein said first and second valve means are arranged to selectively supply pressurized hydraulic fluid to one of said ports and to discharge hydraulic fluid from the other end of said ports of each said unit, and comprising means for throttling fluid discharged from the other of said ports of each said unit.

10. A printing press as defined in claim 2, wherein said first reference indicia comprises a first pair of longitudinally spaced end stops mounted to said doctor slide, wherein said control member is displaceable between the stops of said first pair, wherein said second reference indicia comprises a second pair of longitudinally spaced end stops mounted to said frame, wherein said control member is displaceable between the stops of said second pair, and wherein said first and second control means are responsive to the position of said control member relative to said first and second pair of end stops, respectively, for reversing the direction of movement of said doctor slide upon each engagement of said control member and an end stop of said first pair, and the direction of movement of said control member upon each engagement of said control member and an end stop of said second pair.

11. A drive for oscillating the doctor blade of a gravure type printing press having a press drive in a non-repeat motion comprising:

(a) a frame;

(b) a doctor slide mounted on said frame to be moveable in a longitudinal direction, wherein said doctor slide is adapted to support a doctor blade thereon;

(c) first drive means arranged between said doctor slide and said frame for moving said doctor slide back and forth in said longitudinal direction;

(d) reference indicia means comprising first reference indicia, second reference indicia, and means for moving one of said reference indicia back and forth relative to the other;

(e) a control member;

(f) second drive means for moving said control member back and forth relative to said reference indicia;

(g) means for actuating said first drive means including a first control means independent of said press drive and responsive to the position of said control member relative to one of said first reference indicia and said second reference indicia for controlling the actuation of said first drive means for reversing the direction of movement of said doctor slide; and (h) second control means responsive to the position of said control member relative to the other of said first reference indicia and said second reference indicia for actuating said second drive means for reversing the direction of movement of said control member.

12. A drive as defined in claim 11, wherein said first reference indicia is mounted to said doctor slide for movement therewith in said longitudinal direction and wherein said means for moving said first reference indicia relative to said second reference indicia comprises said first drive means.

13. A drive as defined in claim 12, comprising means for moving said second reference indicia back and forth in said longitudinal direction.

14. A drive as defined in claim 12, wherein said first control means is responsive to the position of said control member relative to said first reference indicia.

15. A drive as defined in claim 12, wherein said first and second drive means comprise a first and second piston and cylinder unit, respectively, and wherein said second piston and cylinder unit is arranged between said frame and said control member for moving said control member in said longitudinal direction.

16. A drive as defined in claim 15, wherein said first reference indicia comprises a first pair of longitudinally spaced ends stops mounted to said doctor slide, and wherein said second reference indicia comprises a second pair of longitudinally spaced end stops mounted to said frame.

17. A drive as defined in claim 16, wherein each of said first and second drive means comprises a source of pressurized fluid, first and second valve means for supplying said fluid to said first and second piston and cylinder unit, respectively, and wherein first and second control means comprise pneumatic means for generating a pressure signal for actuating the respective valve means for oscillating said doctor slide and said control member, respectively.

18. A drive as defined in claim 17, wherein said control member comprises a valve slide, and said pneumatic control means comprises first and second pairs of pneumatic valve means on said valve slide arranged to engage said first and second pairs of end stops, respectively for generating a pressure signal upon each engagement of an end stop.

19. A drive as defined in claim 17, wherein said stops are spring mounted on supports for resiliently engaging said pneumatic valve means.

20. A drive as defined in claim 18, wherein each of said first and second piston and cylinder units comprises a pair of hydraulic ports, wherein said first and second valve means are arranged to selectively supply pressurized hydraulic fluid to one of said ports and to discharge hydraulic fluid from the other of said ports of each said unit, and comprising means for throttling fluid discharged from the other of said ports of each said unit.

21. A drive as defined in claim 12, wherein said first reference indicia comprises a first pair of longitudinally spaced end stops mounted to said doctor slide, wherein said control member is displaceable between the stops of said first pair, wherein said second reference indicia comprises a second pair of longitudinally spaced end stops mounted to said frame, wherein said control member is displaceable between the stops of said second pair, and wherein said first and second control means are responsive to the position of said control member relative to said first and second pair of end stops, respectively, for reversing the direction of movement of said doctor slide upon each engagement of said control member and an end stop of said first pair, and the direction of movement of said control member upon each engagement of said control member and an end stop of said second pair.

22. A method of operating a printing press having a frame, a press drive, a printing cylinder mounted to said frame, a press drive, a doctor blade, and a doctor slide supporting said doctor blade and mounted on said frame for moving said doctor blade in a longitudinal direction relative to said cylinder, comprising the steps of:

(a) establishing a first pair of spaced reference indicia;

(b) establishing a second pair of spaced reference indicia;

(c) locating a control indicia means between the reference indicia of said first pair and between the reference indicia of said second pair for moving between the reference indicia of each respective pair;

(d) moving simultaneously said doctor slide in said longitudinal direction relative to said frame, said first reference indicia relative to said second reference indicia, and said control indicia means relative to said reference indicia wherein the movement of said doctor slide and said indicia is independent of said press drive;

(e) reversing the direction of movement of said control indicia means upon each engagement of said control indicia means and a reference indicia of one of said first pair and said second pair; and (f) reversing the direction of movement of said doctor slide upon each engagement of said control indicia means and a reference indicia of the other of said first pair and said second pair.

23. A method as defined in claim 22, wherein said first pair and said second pair comprise end stops mounted to said frame and said doctor slide, respectively, wherein said control indicia means comprises a valve slide means for supplying a pressure signal upon engagement of any one of said end stops, and comprising the step of supplying pressurized air to said valve slide means for producing said pressure signals for reversing the direction of movement of said valve slide and of said doctor slide.

24. A method as defined in claim 23, wherein there is a hydraulic piston and cylinder unit arranged between said doctor slide and said frame for moving said doctor slide, a second hydraulic piston and cylinder unit arranged between said frame and said valve slide for moving said valve slide, and first and second control valves associated with said first and second piston and cylinder units, respectively, and comprising the steps of supplying said pressure signals to said first and second hydraulic control valves for controlling the direction of motion of said first and second piston and cylinder units.

25. A method as defined in claim 24, wherein said valve slide has first and second pairs of pneumatic valves for supplying said pressure signals and is arranged to engage said first and second pairs of end stops, respectively, and comprising the steps of reversing the direction of movement of said valve slide upon engagement of one of said first pair of pneumatic valves and one of said first pair of end stops, and reversing the direction of movement of said doctor slide upon engagement of one of said second pair of pneumatic valves and one of said second pair of end stops.

26. A method as defined in claim 24 or 25, wherein each piston and cylinder unit has a pair of hydraulic ports, wherein said hydraulic control valves are capable of selectively supplying pressurized fluid to one of said ports and discharging hydraulic fluid from the other of said ports, and comprising the step of throttling the discharged hydraulic fluid during operation.

* * * * *